US008585135B2

(12) United States Patent
Wilson

(10) Patent No.: US 8,585,135 B2
(45) Date of Patent: Nov. 19, 2013

(54) MULTI-POSITION BEACH CHAIR

(76) Inventor: Dean Wilson, Salisbury, NC (US)

( * ) Notice: Subject to any disclaimer, the term of this patent is extended or adjusted under 35 U.S.C. 154(b) by 206 days.

(21) Appl. No.: 12/986,140

(22) Filed: Jan. 6, 2011

(65) Prior Publication Data

US 2011/0285182 A1 Nov. 24, 2011

Related U.S. Application Data

(60) Provisional application No. 61/345,666, filed on May 18, 2010.

(51) Int. Cl.
*A47C 4/34* (2006.01)

(52) U.S. Cl.
USPC ... 297/54; 297/354.15; 297/377; 297/411.34; 297/423.3

(58) Field of Classification Search
USPC ..... 297/54, 354.13, 423.28, 423.3, 423.31, 297/188.18, 377, 411.34
See application file for complete search history.

(56) References Cited

U.S. PATENT DOCUMENTS

| | | | | | |
|---|---|---|---|---|---|
| 253,333 | A | * | 2/1882 | Armstrong | 297/19 |
| 2,024,170 | A | * | 12/1935 | Kruse | 297/372 |
| 2,200,193 | A | | 5/1940 | Taylor | |
| 2,216,317 | A | | 10/1940 | Karish | |
| 3,087,757 | A | * | 4/1963 | Fidel | 297/423.28 |
| 3,967,330 | A | | 7/1976 | Zawadowsky | |
| D283,088 | S | | 3/1986 | McKay | |
| 4,659,142 | A | | 4/1987 | Kuchinsky, Jr. | |
| 4,955,517 | A | * | 9/1990 | Maresca | 224/155 |
| 5,069,503 | A | * | 12/1991 | Martinez | 297/54 |
| D335,585 | S | | 5/1993 | Grosfillex | |
| 5,246,265 | A | * | 9/1993 | Nagan et al. | 297/54 |
| 5,423,592 | A | | 6/1995 | Spurrier et al. | |
| 5,427,435 | A | | 6/1995 | Yoder, Jr. | |
| 5,536,063 | A | | 7/1996 | Cable | |
| D374,128 | S | | 10/1996 | Yoder, Jr. | |
| D394,356 | S | | 5/1998 | Chen | |
| 5,845,969 | A | | 12/1998 | Grimaldi et al. | |
| 6,012,769 | A | * | 1/2000 | Hsueh et al. | 297/19 |
| 6,017,085 | A | * | 1/2000 | LaCroix et al. | 297/173 |
| 6,095,607 | A | | 8/2000 | Wenzel | |
| 6,312,048 | B1 | | 11/2001 | Kilmer | |
| 6,588,034 | B2 | | 7/2003 | Nation | |
| 6,702,384 | B1 | * | 3/2004 | Brown | 297/344.18 |
| 6,935,694 | B2 | | 8/2005 | Turner | |
| 7,207,622 | B2 | | 4/2007 | Cohan et al. | |
| 7,281,767 | B2 | | 10/2007 | Gaylord et al. | |
| 7,438,355 | B2 | | 10/2008 | Pedemonte | |
| 7,631,940 | B1 | * | 12/2009 | Jager | 297/344.18 |
| 7,832,804 | B2 | * | 11/2010 | LaFreniere | 297/411.32 |
| 2002/0095723 | A1 | | 7/2002 | Nation | |
| 2004/0183265 | A1 | | 9/2004 | Vecchio | |
| 2008/0179933 | A1 | | 7/2008 | Puccio | |
| 2010/0078973 | A1 | | 4/2010 | Tyson, III | |

* cited by examiner

*Primary Examiner* — Peter Brown

(57) ABSTRACT

A portable, foldable chair that configures to a straight-back chair, a bed, and a recliner, while also providing standard seat height.

15 Claims, 7 Drawing Sheets

24b
10
20
80
40
32b
32a
22

MULTI-POSITION BEACH CHAIR

CROSS-REFERENCE AND PRIORITY CLAIM TO RELATED APPLICATION

To the fullest extent permitted by law, the present U.S. Non-Provisional Patent Application claims priority to and the benefit of U.S. Provisional Patent Application entitled "All-in-One Beach Chair, Converts from Chair to Lounge Chair to Bed," filed on May 18, 2010, on behalf of inventor Dean Wilson, and having assigned Ser. No. 61/345,666, wherein the referenced application is incorporated by reference herein.

FIELD

The present disclosure relates generally to portable chairs, and more particularly, to a multi-position beach chair.

BACKGROUND

Many individuals enjoy spending time at the beach, whether for sunning, shelling, fishing, reading, or simply relaxing. A typical beachgoer will oftentimes carry a towel, sunscreen, and other accessories in a beach tote and will frequently also carry a folding chair. Numerous options exist for folding chairs however each is disadvantageous in view of the present disclosure.

For relaxing at the beach, an angularly reclined backrest is a popular option, but if a user also desires reclined leg support, presently available beach chair frames disadvantageously eliminate the option for upright seating. That is, upright seating and reclined backrest options are provided together, and reclined backrest and reclined leg support options are provided together, but no configuration offers all three options in one portable chair. Back support provided by presently available beach chairs is disadvantageous because back and leg positioning is not selectively convertible.

Still, some beachgoers prefer a chaise lounge for beach enjoyment in a fully prone position. A short-legged tri-fold style chaise remains popular for lying out prone, and also offers an adjustable backrest and reclined leg support. Unfortunately, such a foldable chaise is unable to serve as a traditional chair, wherein instead, for example, if a user were to desire to sit upright, he or she would necessarily be obligated to straddle the chair, or to sit sideways on the chaise in order to place feet on the ground. Moreover, the short-legged style, as with other short-legged beach chairs, while enjoyed by those who prefer to be close to the sand and/or water, is disadvantageously difficult or almost impossible to exit for many, requiring a user to raise to a standing position from a low center of gravity.

Standard height folding chairs enable a user to avoid such a difficult exit. However, portable chairs offering standard height are generally and disadvantageously limited in configurable positions, such that upright seating is exclusively offered. Even portable chairs that offer adjustable height legs are disadvantageous in view of the present invention by remaining limited in configurable positions. Moreover, known folding chair frame designs are generally not designed to support persons of a larger frame and/or heavier scale.

Therefore, it is readily apparent that there is a need for a portable, foldable chair that configures to a sturdy straight-back chair, a bed, and a recliner, while also providing standard seat height.

BRIEF SUMMARY

Briefly described, in a preferred embodiment, the present device overcomes the above-mentioned disadvantages and meets the recognized need by providing a multi-position beach chair that is adapted to define a: (1) compact, folded position for convenient transport, (2) standard height, upright seating position, wherein feet may be placed flat on the ground, (3) reclined position, wherein back and legs may be angularly supported, and (4) prone position, wherein a user may lay flat, as on a bed.

According to its major aspects and broadly stated, in its preferred form, the present beach chair enables multi-positional functionality, improved ease of use, secure and adjustable features, facilitated ease of entry and exit, and minimization of sand and debris impact by allowing direction of blown materials under the chair, amongst other benefits.

More specifically, the device of the present disclosure in its preferred form is an improved multi-position beach chair comprising three main body support elements, a back, a seat, and a footrest, wherein the combination and structure of the body support elements enables at least three distinctive user positions, wherein a first position is an upright chair position with a generally straight chair back and no extended footrest, a second position is a bed position with all three body support elements essentially flat and in a single plane, and wherein a third position is a reclined lounge position with a partially declined footrest and optionally partially declined back. According to the preferred embodiment, a cushion is included, wherein a removable, multi-section cushion is preferred, formed from high-density foam and covered with durable yet comfortable outdoor canvas material.

Preferably, traditional full-chair-height legs are swivelably attached to the seat and may preferably be fixed into position for use with removable pins, or may be swiveled into the plane of the seat frame for folded transport. Armrests, too, may be swivelably connected with pins, wherein a sturdy and supportive relationship to the chair frame is adjustably provided, yet armrests may also preferably pivot and stow under the seat. Each of the plurality of selectably positioned pins facilitates feature set-up by the user according to personal preference. This may include leg height, wherein overall chair height may be extended even further in an embodiment with telescoping and fixable legs.

It is also noteworthy that accessories, such as a tray and/or a cupholder may be provided with the present beach chair device, wherein such accessories may operatively engage with an armrest, for example, or may be integrally formed therewith. Moreover, in order to facilitate ease of transport, part or all of the chair legs may be adapted or installed with wheels or other rollable and/or slidable features, wherein a full complement of four wheels enables, for example, the presently described device to transport a person.

Materials of construction for the presently described multi-position beach chair are preferably selected for characteristics such as strength, lightweight nature, resistance to corrosion, and weatherability. For example, and without limitation, aluminum, polyvinyl chloride (PVC), and/or any other natural or manmade material may be utilized, either alone or in combination with other material(s), as long as the preferred characteristics are considered, recognizing however that a beach chair constructed with inferior materials, such as heavy and/or easily corrodible materials, but according to that structure as described herein is intended to be within the scope of the present disclosure.

Accordingly, a feature and advantage of the present device is its ability to support a person of large stature.

Another feature and advantage of the present device is its ability to convert from an upright chair to a lounge chair to a bed.

Still another feature and advantage of the present device is its ability to allow for ease of entry and exit of a user, by raising the user's center of gravity and by providing armrests that are easily moveable into and out of position.

Yet another feature and advantage of the present device is its ability to provide back support to a user, with adjustable back and leg positioning.

Still yet another feature and advantage of the present device is its ability to fold flat to its frame for easy, one-handed transport.

Another feature and advantage of the present device is its ability to enable a user to exit from the side, yet still provide an armrest, as may be desired.

Yet still another feature and advantage of the present device is its ability to be utilized as a beach chair, or resort or cruise line seating, and also to be selectively utilized in other non-recreative environments, such as in nursing homes, assisted living centers, rehabilitation facilities, and/or hospitals for older adults, larger persons, and/or for those with special needs, These and other features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATE EMBODIMENTS

Figure 1:
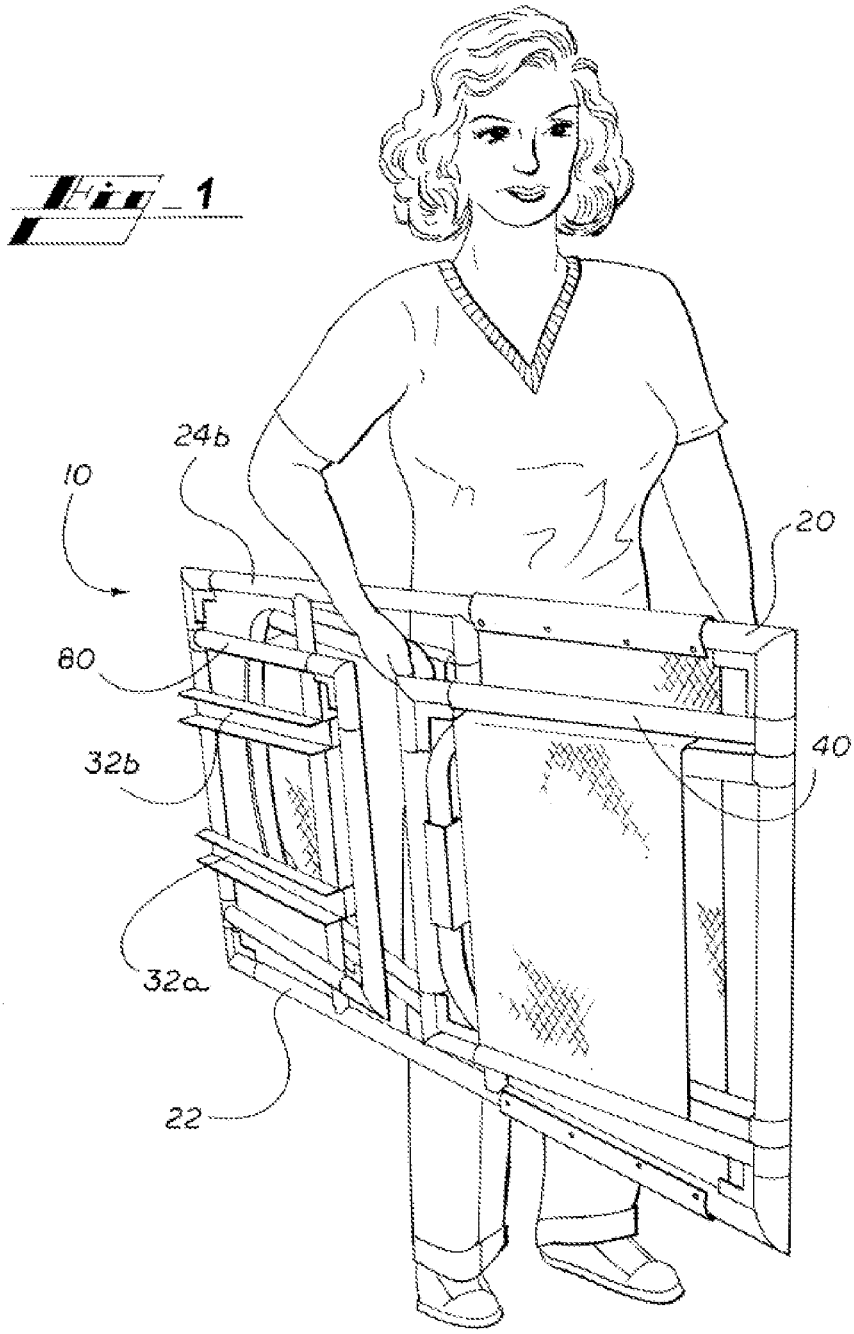
FIG. 1 is a perspective view of a multi-position beach chair, according to the preferred embodiment of the present device, showing the device being carried in a folded position.

In describing the preferred and alternate embodiments of the present device, as illustrated in the figures and/or described herein, specific terminology is employed for the sake of clarity. The device, however, is not intended to be limited to the specific terminology so selected, and it is to be understood that each specific element includes all technical equivalents that operate in a similar manner to accomplish similar functions.

Referring now to FIGS. 1-4, multi-position beach chair 10 preferably comprises frame 20, back 40, seat 60, and footrest 80, wherein seat 60 is preferably a coplanar part of frame 20, and wherein back 40 and footrest 80 are each preferably swivelably related to frame 20. Preferably, front leg member 100 and rear leg member 102 are each also pivotally related to frame 20. Plurality of removable pins 110 preferably facilitate selective and secure positioning of each pivotal and swivelable element while inserted, and allow for formation of a generally flat configuration for transport when removed.

Preferably, frame 20 is rectangularly shaped, defining base periphery 22 for multi-position beach chair 10 with elongate side frame members 24*a*, 24*b*, rear frame member 26*a*, and front frame member 26*b*. First cross support frame member 28 and second cross support member 30 are each preferably positioned between elongate side frame members 24*a*, 24*b*, preferably perpendicularly related thereto, wherein back 40 is preferably pivotally related to first cross support frame member 28. Preferably, back supports 32*a*, 32*b* are positioned generally between rear frame member 26*a* and second cross support member 30, preferably perpendicularly related thereto, and wherein each back support 32*a*, 32*b* is of a length that extends a distance from second cross support member 30, away from rear frame member 26*a*, and towards back 40. Each back support 32*a*, 32*b* is preferably adapted with respective positional stop member 34*a*, 34*b*, wherein secure placement of positional stop members 34*a*, 34*b* may be accomplished with bolts, welding, or any other suitable means from the art.

According to the preferred method of manufacture, with preferred materials, frame 20 is formed as a singular piece of aluminum tubing, bent into a rectangular shape, wherein first cross support frame member 28 and second cross support member 30 are welded thereinto, to increase rigidity and overall support strength. One skilled in the art should readily recognize that although an integrally formed aluminum frame with welded supports is preferred, other frame constructions and materials could be utilized, such as formation from a plurality of bracketed members, securely adhered or otherwise related PVC members, galvanized pipe, or any other suitable materials that would provide the desirable or necessary features described herein, namely strength, durability, resistance to corrosion, weatherability, and overall light-weight nature.

Figure 2:
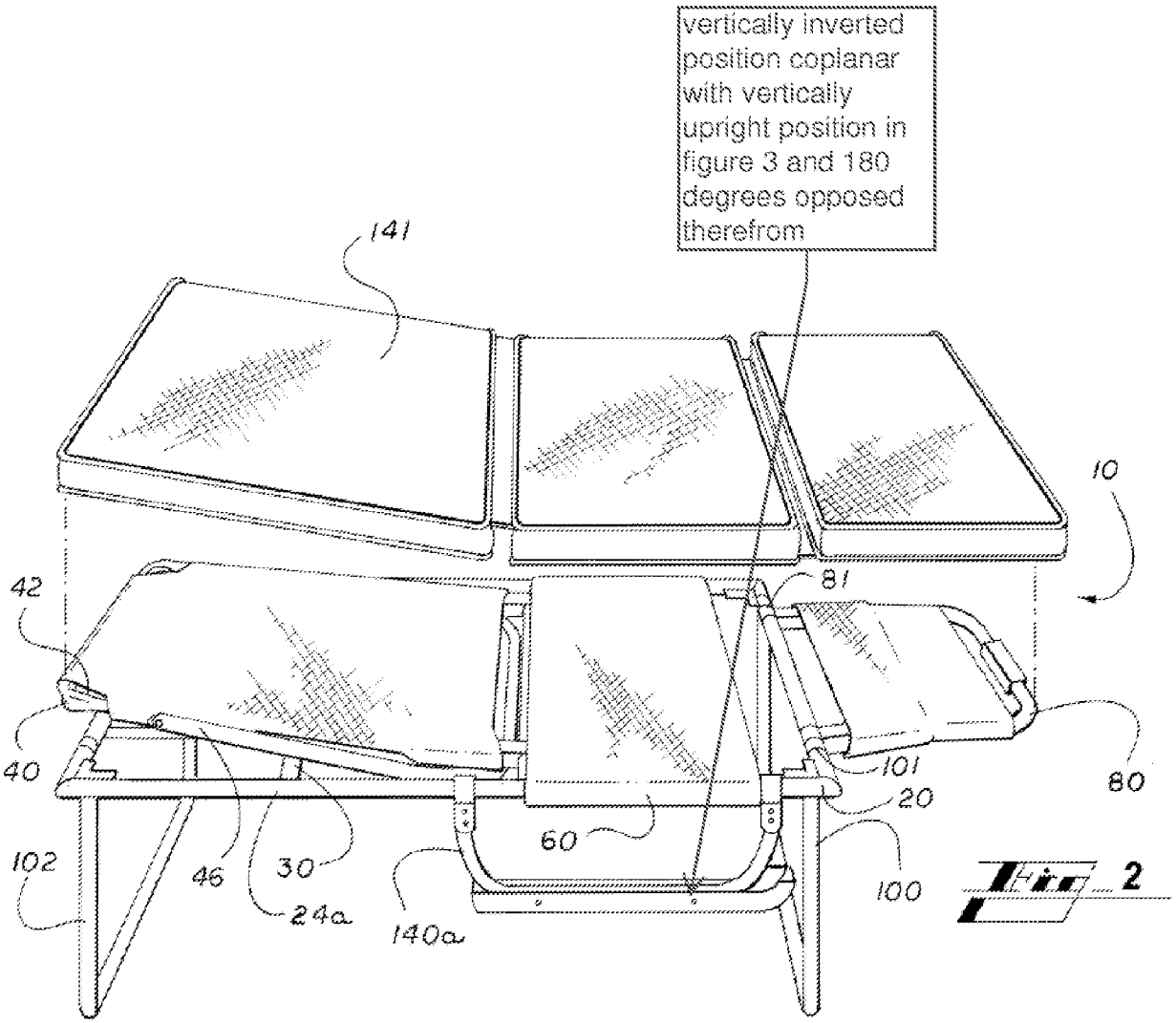
FIG. 2 is a perspective view of the multi-position beach chair of FIG. 1, showing the chair positioned as a bed, and showing a removable cushion.
Figure 3:
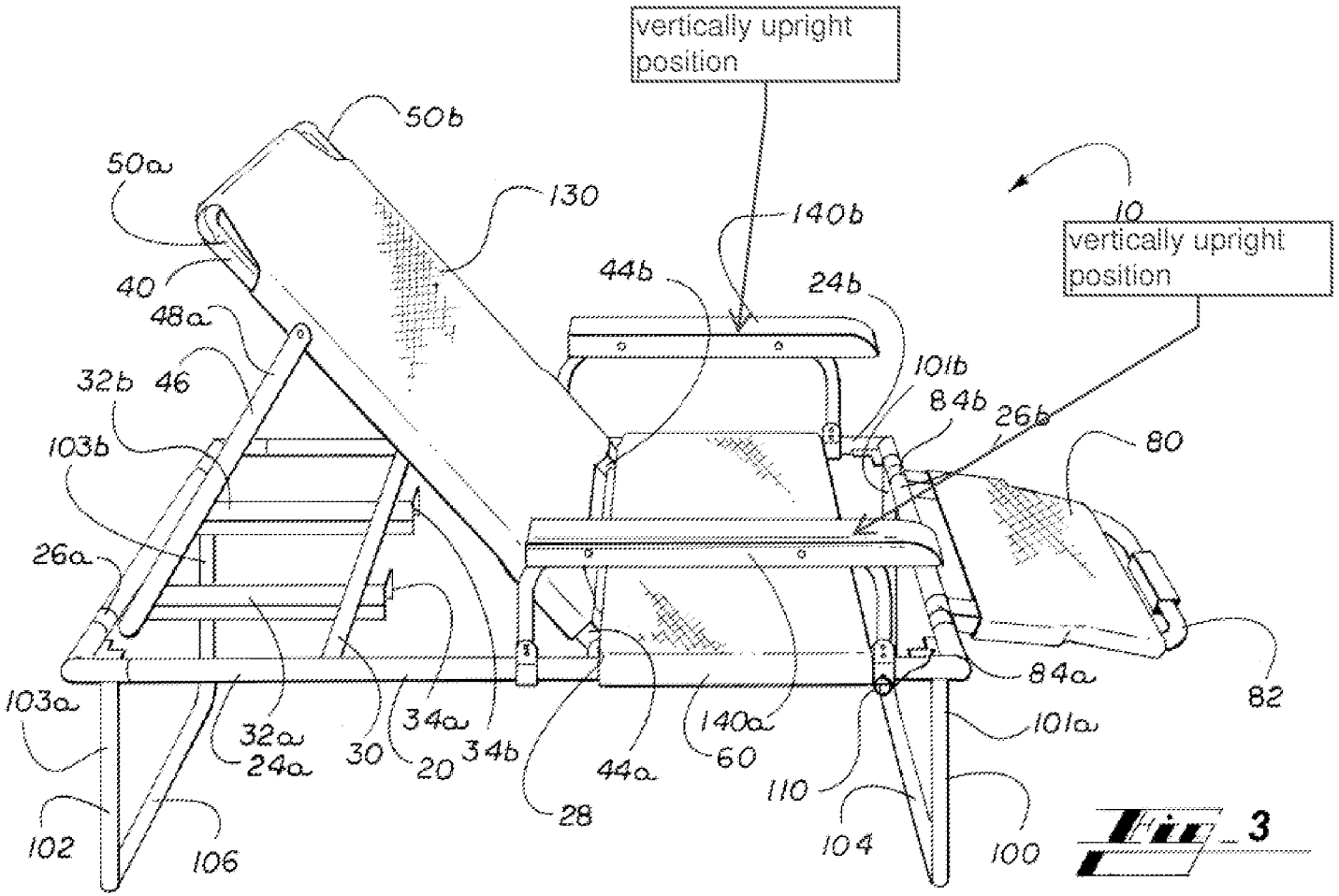
FIG. 3 is a perspective view of the multi-position beach chair of FIG. 1, showing the chair positioned as a recliner.
Figure 4:
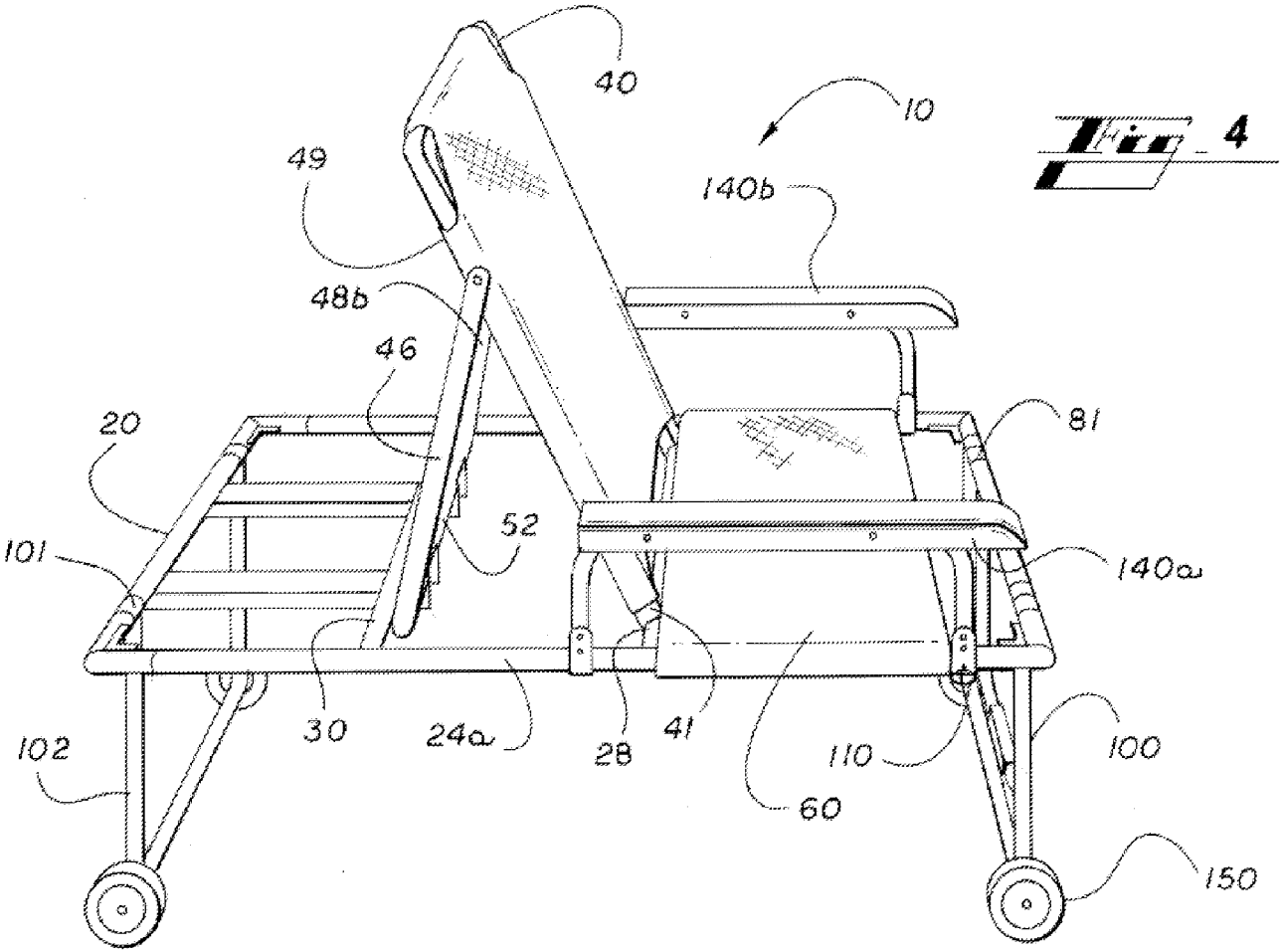
FIG. 4 is a perspective view of the multi-position beach chair of FIG. 1, showing the chair in an upright seating position.

According to the preferred embodiment, back 40 is defined by generally U-shaped member 42, with pivotal base connectors 44*a*, 44*b* preferably operatively engaged with first cross support frame member 28 in such manner as to enable a 180° range of movement for back 40 relative to the plane of frame 20. Back support arm 46 is preferably U-shaped, with pivotal lengths 48*a*, 48*b* operatively engaged with side supports 50*a*, 50*b* of back 40, and support length 52 extending therebetween. Back support arm 46 is preferably dimensioned to enable removable engagement between second cross support member 30 and positional stop members 34*a*, 34*b*, resting on back supports 32*a*, 32*b* for definition of upright position A, as depicted in FIG. 4. Back support arm 46 is also preferably dimensioned to enable removable engagement proximate rear frame member 26*a*, preferably abuttingly related thereto, and resting on back supports 32*a*, 32*b* for definition of reclined position B, as depicted in FIG. 3. Moreover, back support arm 46 is preferably dimensioned to enable disassociation from back supports 32*a*, 32*b*, and positioning proximate rear surface 49 of back 40 for definition of bed position C, as depicted in FIG. 2.

Preferably, U-shaped member 42 of back 40 is formed from a single piece of aluminum tubing bent into the U-shape, and with sleeve 41 at each end for swivelable engagement with frame 20. Again, as with frame 20, one skilled in the art should readily recognize that although a singularly formed U-shaped member with end sleeves 41 is preferred, other back constructions and materials could be utilized, such as formation from a plurality of bracketed members, securely adhered or otherwise related PVC members, or any other suitable materials that would provide the supportive strength necessary to perform as described and to enable desirable characteristics for portable transport. Moreover, as representatively depicted in FIG. 7B, U-shaped member 42 may be adapted with alternate back support arm 47, wherein height adjustment features may be provided.

Front leg member 100 and rear leg member 102 are each preferably U-shaped, defined by respective leg height members 101*a,b* and 103*a,b* and respective cross support members 104 and 106. Leg height members 101*a,b* of front leg member 100 are preferably swivelably engaged with front frame support member 26*b*, and leg height members 103*a,b* of rear leg member 102 are preferably swivelably engaged with rear frame support member 26*a* in such manner as to enable a 90° range of movement for each leg member 100, 102 relative to the plane of frame 20. Each leg member 100,102 is preferably formed from a single piece of aluminum tubing bent into the U-shape, and with sleeve 101 at each end for swivelable engagement with frame 20. Moreover, each leg height member 101*a,b* and 103*a,b* is preferably fourteen inches in length, thereby defining a "full" or traditional chair height, such as to provide a most preferred 18-inch seat height, wherein ease of entry and exit is consistently facilitated, and wherein during windy beach conditions, sand and other undesirable debris may blow under frame 20 rather than impacting the user. Other heights lengths could be utilized for leg height members 101*a,b* and 103*a,b*, as desired, but standard height relative to traditional chairs is preferred in order to realize each of the preferred embodiment features and benefits of multi-position beach chair 10. Of course, as with frame 20, one skilled in the art should readily recognize that although an singularly formed leg member with end sleeves 101 is preferred, other leg constructions and materials could be utilized, such as formation from a plurality of bracketed members, securely adhered or otherwise related PVC members, or any other suitable materials that would provide the strength and dimensional relationship relative to frame 20 so as to enable upright seating with a seated user's feet flat on the ground. As representatively depicted in FIG. 7A, alternate leg member 105 could be utilized to enable leg height adjustment, as desired.

Figure 5:
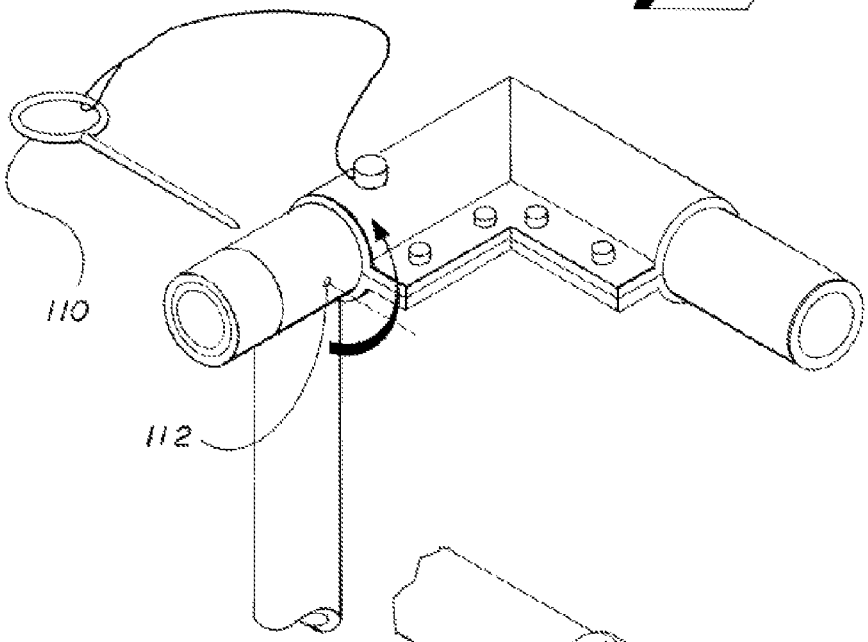
FIG. 5 is a partial perspective view of the frame of the multi-position beach chair of FIG. 1, showing a pivotal frame element and a securing pin removed therefrom.
Figure 6:
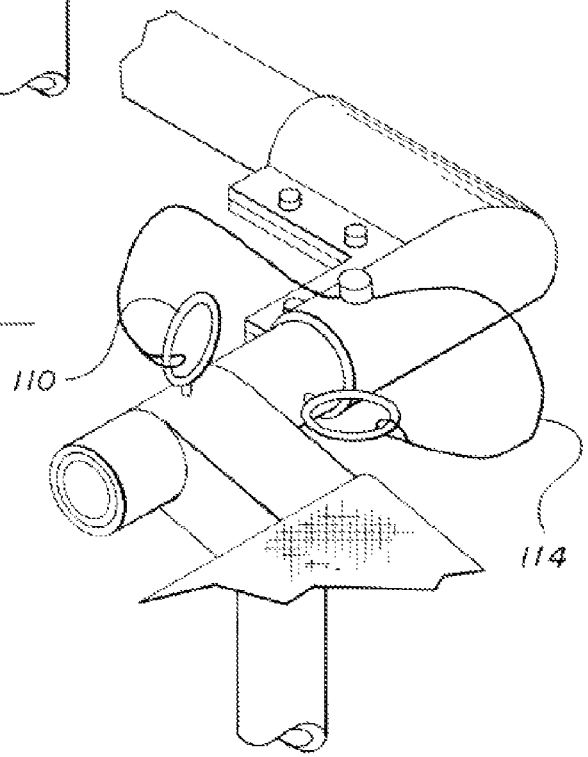
FIG. 6 is a partial perspective view of the pivotal frame element and securing pin of FIG. 5, showing the securing pin in place.

Footrest 80 is preferably defined by U-shaped member 82, with pivotal connectors 84*a*, 84*b* preferably operatively engaged with front frame support member 26*b*, preferably proximate and between leg height members 101*a,b* of front leg member 100, in such manner as to enable a 270° range of movement for footrests 80 relative to the plane of frame 20. Footrest 80 is preferably dimensioned and of an overall length to enable generally flush positioning thereof relative to front leg member 100 for definition of footrest position A, as shown in FIG. 4, wherein a user's feet may be flat on the ground surface while seated. Preferably, with reference to FIGS. 5 and 6, front frame support member 26*b* and pivotal connects 84*a*, 84*b* are adapted with selectable plurality of apertures 112, wherein insertion of a respective plurality of removable pins 110 therewithin serves to fix footrest 80 relative to frame 20. For selective definition of footrest position B, as depicted in FIG. 3, plurality of removable pins 110 are inserted into plurality of apertures 112 such that footrest 80 forms an acute angle with the plane of front leg member 100. For selective definition of footrest position C, as depicted in FIG. 2, plurality of removable pins 110 are inserted into a different plurality of apertures 112 such that footrest 80 is fixed in a position coplanar with frame 20.

Preferably, each pin of plurality of removable pins 110 has cable 114 securely related thereto, wherein each cable 114 is preferably securely related to frame 20. In such manner, plurality of removable pins 110 may remain generally associated with frame 20 irrespective of direct engagement therewith. In similar fashion to footrest 80, front leg member 100 and rear leg member 102 may preferably be locked into a selected support position by engagement of a select plurality of removable pins 110 with selected plurality of apertures 112. Plurality of cables 114 may be related to frame 20 according to any suitably secure means, however, riveted positioning is preferred.

According to the preferred embodiment, frame 20, seat 60, and footrest 80 of multi-position beach chair 10 are each provided with supportive fabric 130. Fabric 130 may directly contact and support the user. However, in the preferred embodiment, cushion 141 is removably positioned proximate fabric 130 for additional back support and comfort. Both support fabric 130 and cushion 141 are preferably constructed from water-resistant outdoor fabric, or other suitable covering known in the art for such applications, such as, for exemplary purposes only, composite webbing, canvas, or any other desirable covering. Support fabric 130 is preferably securely fastened to chair 10, such as with rivets, adhesive, or the like, but may be removable related, such as with snaps or other means. Cushion 141 is preferably formed as a three-section high density foam cushion, adapted to bend according to the selected positional arrangement of chair 10.

As noted relative to frame 20 and back 80, footrest 80 and back support arm 46 are each preferably bent from a singular piece of aluminum tubing, with footrest 80 bearing sleeves 81 at each end, and back support arm 46 distinguished by flattened ends. As noted, other materials and methods of manufacture may be utilized without departing from the intended scope of the present disclosure, wherein any suitable materials may be related according to the design disclosed to enable multi-positional enjoyment of a standard height beach chair.

In a further embodiment of the present device, armrests 140*a*, 140*b* are pivotally engaged with respective elongate side frame members 24*a*, 24*b* of frame 20. As depicted in FIG. 3, a select one of plurality of pins 110 is located proximate to each armrest 140*a*, 140*b* for engagement therewith, thereby securing each armrest 140*a*, 140*b* in an upright position for use. Referring now to FIG. 2, it should be appreciated that without such engagement of pin 110, armrest 140*a*, 140*b* may be pivoted about respective elongate side frame member 24*a*, 24*b*, out of the plane of frame 20, thereby enabling a user to exit chair 10 from a side, as may be desired or required according to physical limitations, without any obstacle.

Figure 7A:
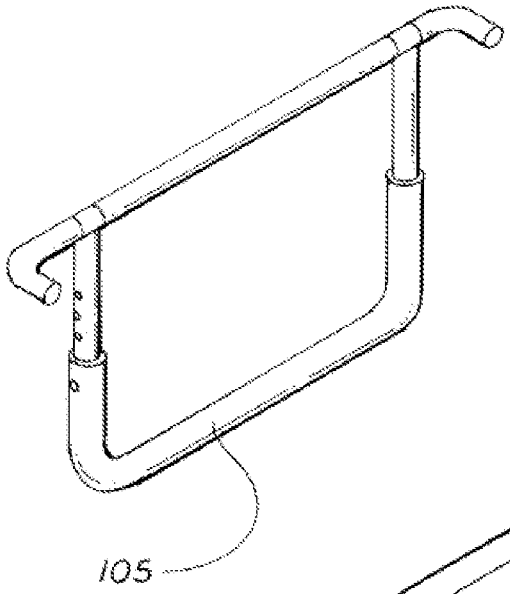
FIG. 7A is a perspective view of an alternate leg member, adapted for adjustable height.
Figure 7B:
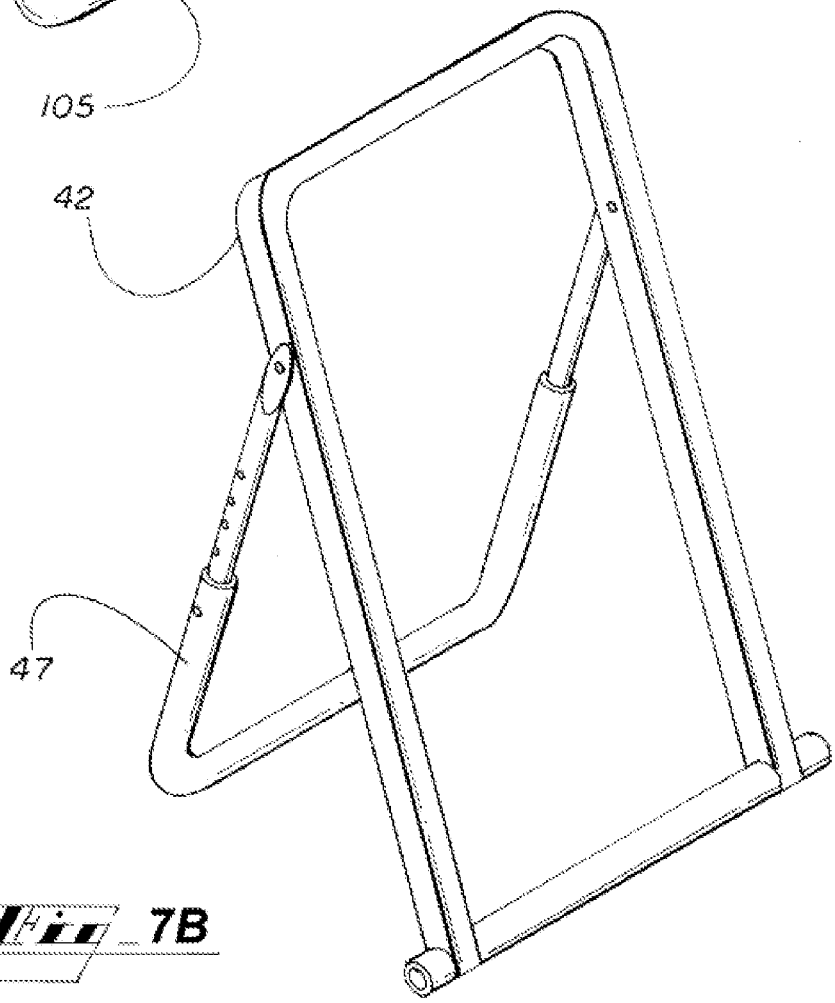
FIG. 7B is a perspective view of an alternate back support arm, adapted for adjustable height.
Figure 8A:
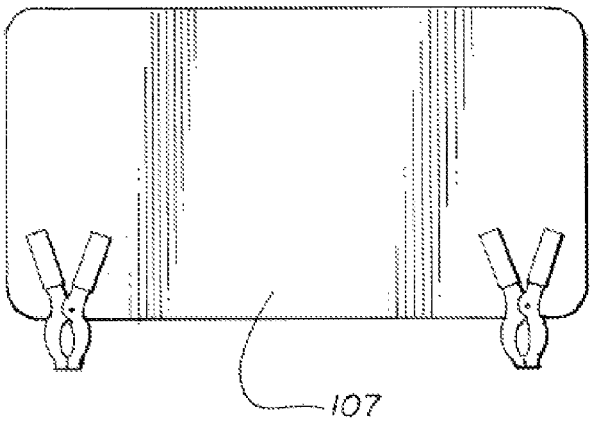
FIG. 8A is a bottom view of a removable tray, according to an alternate embodiment.
Figure 8B:
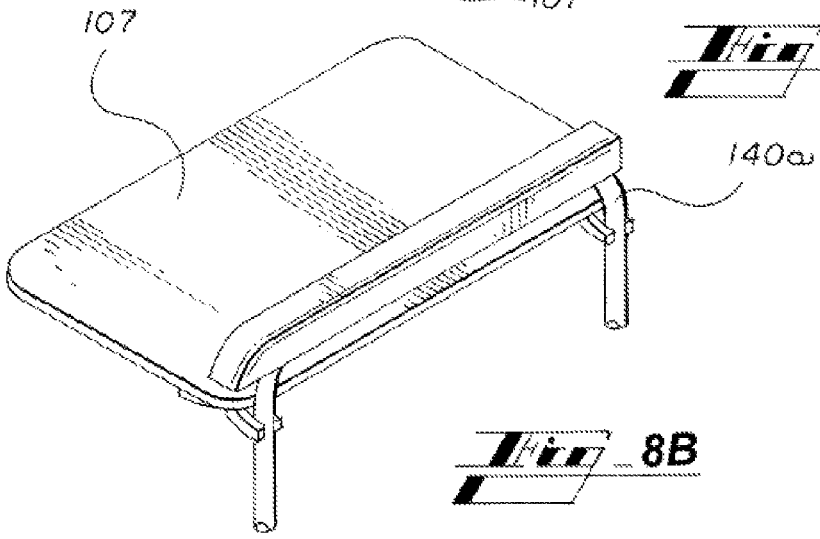
FIG. 8B is a perspective view of the removable tray of FIG. 8A, showing the tray installed on an armrest.
Figure 7C:
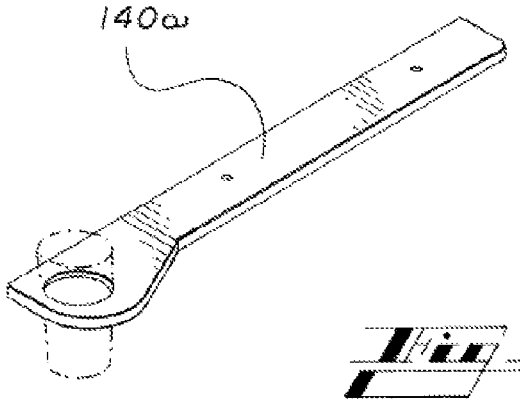
FIG. 7C is a perspective view of an alternate armrest, showing a cupholder related thereto.

In a further embodiment, armrest 140*a*, 140*b* may be adapted with one or more cupholders, as representatively shown in FIG. 7C, and/or with removable tray 107 configured for removable engagement therewith, such as, for exemplary purposes only, as shown in FIGS. 8A-8B, with plurality of engageable clips 109 for removable fastening to a single armrest 140*a* or 140*b*, alongside a user, or to both armrests

140*a* and 140*b*, across a user's lap. Of course, other means of engagement may be utilized, as may be appropriate, convenient, or desired.

In yet another embodiment, a plurality of wheels 150 may be installed proximate front leg member 100 and/or rear leg member 102. Depending upon the total number of wheels 150, chair 10 may function as a rolling bed, a wheeled chair, or a two-wheeled device for either ease of transport of folded chair 10, or for reclined transport of a seated user.

In still another embodiment, front leg member 100 and rear leg member 102 may be height adjustable, such as in alternate leg member 105. For example, and without limitation, each leg member 100, 102 may be formed as a multi-element telescoping member, such as shown in FIG. 7A, with selectable pin-receiving apertures enabling a variety of seat height selections.

In another alternate embodiment, back support arm 46 could be formed as two independent arms and/or could be installed inside of the periphery of back 40, with the ability to pivotally collapse fully within the periphery thereof, and facilitate creation of a fully flat configuration. Moreover, additional stops or otherwise selectable positions on back support members 32*a*,32*b* could allow for additional recline positions for back 40.

According to the preferred method for assembly and connection of components, frame 20 preferably functions as a base element for connective support of all other parts. Each leg member 100, 102 is preferably attached to frame 20 by slidable attachment of each leg member 100,102 sleeve 101 onto front frame member 26*b* and rear frame member 26*a*. Similarly, back 40 and footrest 80 are slidably related, respectively to first cross support member 28 and front frame member 26*b*. Each leg member 100,102 is preferably secured relative to frame 20 by plurality of pins 110, inserted through sleeve 101 of each leg member 100,102 and into frame 20.

Preferably, back support arm 46 is hingedly secured to back 40 with nut and bolt fasteners known in the art. It should be recognized that any suitable and appropriate fastening means could be utilized without departing from the intended scope of the present disclosure, such as, for exemplary purposes only, a compression or cotter pin, a hinge, spring, or the like. Positional stop members 34*a*, 34*b* are preferably fixedly secured to frame 20 with a plurality of bolts and lock nuts, as known in the art. As previously noted, other fastening means may be utilized and/or positional stop members 34*a*, 34*b* may be welded or integrally formed with frame 20.

Accordingly, as described, selectable adjustment of multi-position beach chair 10 enables definition of three in-use positions: (A) as an upright seat with a users feet flat on the ground, (B) as a recliner, with an angularly reclined back and an angularly declined footrest, and (C) as a bed, with an essentially coplanar back, seat, and footrest, and also a storage and transport position (D) folded flat. In use, first, leg member 100, 102 may be rotated into a generally perpendicular position relative to the plane of frame 20, and leg members 100,102 for secure support of chair 10 thereupon. Once secure, any of the plurality of positions may be selected.

For position (A), back support arm 46 may be raised to position between second cross support member 30 and positional stop members 34*a*, 34*b*. Coincidentally thereto, footrest 80 may be lowered to a position essentially flush with front leg member 100. Generally, in preferred position A, back 40 and footrest 80 are each perpendicular to the plane of frame 20, defining a standard upright chair configuration. For position (B), back support arm 46 may be lowered to position proximate rear frame member 26*a*, forming an acute angle relative to the plane of frame 20. Footrest 80 may be raised to form an acute angle relative to the plane of front leg member 100, preferably about 45°, but any desirable angle may be selected. Plurality of pins 110 may be installed to fix the selected position of footrest 80 for use. For position (C), back support arm 46 may be positioned generally flush against back 40, thereby enabling back 40 to define a position relatively near coplanar, or parallel, with the plane of frame 20. Footrest 80 may be raised and secured to form, preferably, a right angle relative to the plane of front leg member 100. Support surfaces of chair 10 are generally horizontal, relative to the ground, in such a position. Finally, for position (D), back 40 may be rotated and positioned in a generally flush position relative to the plane of frame 20. Similarly, footrest 80 may be rotated and positioned in a generally flush position relative to the plane of frame 20, and proximate back 40, and leg members 100,102 may be opposingly rotated and opposingly positioned also proximate back 40. At any time, cushion 141 may be placed thereupon, as desired.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

I claim:

1. A multi-position beach chair, comprising:

a frame, said frame defined by a rectangularly shaped periphery, a plurality of cross support members, and at least one back support and stop member;

a plurality of leg members pivotally connected to said frame, wherein each of said plurality of leg members is of a length that enables said beach chair to possess a standard seat height;

a back pivotally connected to one of said plurality of cross support members;

a seat, wherein said seat is coplanar with said frame; and a footrest pivotally connected to said frame proximate said seat;

wherein said plurality of leg members are configured to pivot from a first position generally flush with said frame to a second position essentially perpendicular to said frame;

wherein said back is configured to pivot from a first position generally flush with said frame to a second position approximately 180° from said first position and generally coplanar with said frame, and with a plurality of selectable positions therebetween according to an interaction of said at least one back support and stop member; and wherein said footrest is configured to pivot from a first position generally flush with said frame to a second position approximately 180° from said first position and generally coplanar with said frame, to a third position approximately 45° from said second position, and to a fourth position approximately 45° from said third position and generally perpendicular to said frame;

at least one armrest, wherein said at least one armrest is swivelably connected to said frame, and further comprising at least one pin removably connected to said at least one armrest, wherein said at least one pin is dimensioned to extend through at least a portion of said armrest and into said frame, thereby securing a selected position therefore;

wherein said at least one armrest is selectively pivoted along a 180 degree rotational path defined out of a plane of said frame such that said at least one armrest is pivoted between a vertically upright position and a vertically inverted position opposed therefrom;

wherein said vertically upright position is coplanar with said vertically inverted position;

wherein said vertically upright position is oppositely spaced 180 degrees from said vertically inverted position.

2. The multi-position beach chair of claim 1, further comprising a cushion.

3. The multi-position beach chair of claim 2, wherein said cushion is formed from high-density foam and a covering.

4. The multi-position beach chair of claim 1, further comprising a plurality of pins removably connected to said plurality of leg members and said frame, wherein each of said plurality of pins is dimensioned to extend through at least a portion of one said leg member of said plurality of leg members and into said frame, thereby securing a selected position therefore.

5. The multi-position beach chair of claim 1, wherein each of said plurality of leg members further comprises a plurality of telescoping portions and means for securing a relative position between said telescoping portions.

6. The multi-position beach chair of claim 1, wherein said means for securing a relative position between said telescoping portions is further comprises a plurality of apertures in said plurality of telescoping portions and a positional lock selected from the group consisting of a plurality of pins or a spring-loaded lock.

7. The multi-position beach chair of claim 1, wherein said at least one armrest further comprises at least one cupholder.

8. The multi-position beach chair of claim 1, further comprising a tray, wherein said tray is removably carried by said at least one armrest.

9. The multi-position beach chair of claim 1, further comprising a plurality of wheels, wherein each of said plurality of wheels is carried by one of said plurality of leg members.

10. The multi-position beach chair of claim 1, wherein said length of each of said plurality of leg members is fourteen inches.

11. The multi-position beach chair of claim 1, further comprising a plurality of pins removably connected to said footrest and said frame, wherein each of said plurality of pins is dimensioned to extend through at least a portion of said footrest and into said frame, thereby securing a selected position therefore.

12. The multi-position beach chair of claim 1, further comprising a plurality of pins with cables, wherein each of said cables is securely fastened to said frame, and wherein each of said plurality of pins with cables is removably inserted into a chair element selected from the group consisting of said footrest, said back, and said plurality of leg members and into said frame.

13. The multi-position beach chair of claim 1, further comprising fabric carried by said frame, said back, and said footrest.

14. A multi-use chair, comprising:

a frame, said frame defined by a rectangularly shaped periphery, a plurality of cross support members, and at least one back support and stop member;

a plurality of leg members pivotally connected to said frame, wherein each of said plurality of leg members is of a length that enables said beach chair to possess a standard seat height;

a back pivotally connected to one of said plurality of cross support members;

a seat, wherein said seat is coplanar with said frame;

a footrest pivotally connected to said frame proximate said seat;

a plurality of pins removably extended through said footrest and into said frame; and a supportive covering carried by said frame, said footrest, and said seat, wherein said plurality of leg members are configured to pivot from a first position generally flush with said frame to a second position essentially perpendicular to said frame;

wherein said back is configured to pivot from a first position generally flush with said frame to a second position approximately 180° from said first position and generally coplanar with said frame, and with a plurality of selectable positions therebetween according to an interaction of said at least one back support and stop member; and wherein said footrest is configured to pivot from a first position generally flush with said frame to a second position approximately 180° from said first position and generally coplanar with said frame, to a third position approximately 45° from said second position, and to a fourth position approximately 45° from said third position and generally perpendicular to said frame;

at least one armrest, wherein said at least one armrest is swivelably connected to said frame, and further comprising at least one pin removably connected to said at least one armrest, wherein said at least one pin is dimensioned to extend through at least a portion of said armrest and into said frame, thereby securing a selected position therefore;

wherein said at least one armrest is selectively pivoted along a 180 degree rotational path defined out of a plane of said frame such that said at least one armrest is pivoted between a vertically upright position and a vertically inverted position opposed therefrom;

wherein said vertically upright position is coplanar with said vertically inverted position;

wherein said vertically upright position is oppositely spaced 180 degrees from said vertically inverted position.

15. The multi-use chair of claim 14, further comprising a removable, hinged cushion.

* * * * *